United States Patent [19]

Wright

[11] 3,977,452

[45] Aug. 31, 1976

[54] ROLL-IN CASE

[76] Inventor: Marjorie E. Wright, 929 Greentree Drive, Winter Park, Fla. 32789

[22] Filed: Nov. 15, 1974

[21] Appl. No.: 524,083

[52] U.S. Cl. ..... 150/3; 53/29; 53/32; 150/52 R; 206/.5; 206/438; 15/209 R

[51] Int. Cl.[2] ..... B65B 43/02

[58] Field of Search ..... 53/29, 32, 31; 150/3, 150/7, 52 R, 52 C; 206/.5, 438; 401/201, 205; 220/56, 72; 15/118, 209 R

[56] References Cited

UNITED STATES PATENTS

| | | | |
|---|---|---|---|
| 1,469,917 | 10/1923 | Dessau | 401/201 |
| 2,607,940 | 8/1952 | Miller | 401/201 X |
| 2,709,467 | 5/1955 | Hoeppner | 150/7 |
| 3,034,169 | 5/1962 | Vitale | 401/201 |
| 3,072,952 | 1/1963 | Cox | 401/201 |
| 3,377,121 | 4/1968 | Billesbach | 401/7 |
| 3,557,519 | 1/1971 | Lyon | 53/31 |

*Primary Examiner*—Travis S. McGehee
*Assistant Examiner*—John Sipos
*Attorney, Agent, or Firm*—Julian C. Renfro

[57] ABSTRACT

A locking case of foldable material into which any of a wide variety of articles can be encapsulated. My case is equipped with a mouth or opening, but instead of this opening leading directly into the interior of the case, it leads instead into an inlet of tortuous configuration, which serves to prevent loss or dislodgement of items that have been placed in the interior of the case by following a novel encapsulation procedure. This procedure involves the case being turned inside-out for a number of times in one direction, such as three times, and then after placement of the item adjacent one side of the case, the case is turned inside-out in the other direction until such time as a plurality of layers of the material are caused to be disposed on each side of the encapsulated item. Advantageously, no fasteners of any kind are involved in making the encapsulated item or items secure against dislodgment.

21 Claims, 23 Drawing Figures

ROLL-IN CASE

BACKGROUND OF THE INVENTION

1. Field of the invention

Figure 1:
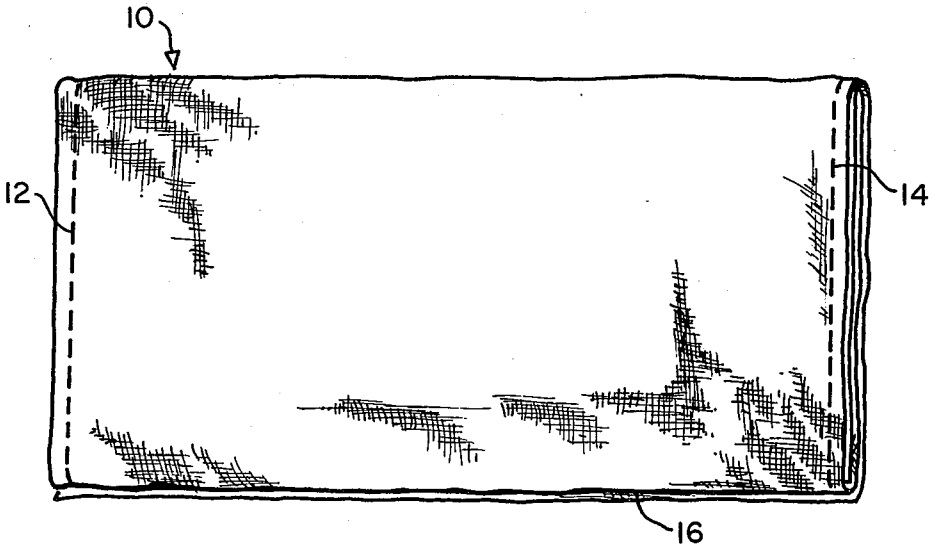

This invention relates to a case for items such as soap and the like, and, more particularly, to a soap case having novel means for retaining and securing the opening to the interior of the case in order to prevent the inadvertent release or ejection of soap, and which is readily adapted to be employed as an assembly by the user for washing and bathing purposes.

2. Description of the prior art

Washcloths provided with soap receiving portions are well known in the prior art; however, certain problems have been experienced with such prior washcloths, involving the difficulty in inserting and retaining a bar of soap in the soap pocket, and further, in the application by the user of the combined washcloth and soap, to the back and less accessible parts of the body. Fabrication of such soap pouches or washcloth soap assemblies from open mesh fiber cloth presents a number of problems which heretofore have not been satisfactorily solved. It would be desirable, of course, to provide a pouch design or assembly which can be constructed as simply and economically as possible. However, the assembly must also be convenient to use, and this requirement has tended to complicate the fabrication procedure. For satisfactory performance and use, it must be relatively easy to insert cakes or pieces of soap or other detergent material into the pouch or pocket, while at the same time having the pouch constructed so that the soap or detergent material will not be ejected from the pouch while it is being employed by the user for washing or bathing purposes.

One attempt to provide a satisfactory washcloth having a soap receiving pocket is disclosed in U.S. Pat. No. 3,124,827 wherein a washcloth is provided comprising a band of absorbent material and two sets of handle-forming draw strings wherein each set of draw strings is operatively connected to close a respective end of the band. The band forms a soap-receiving pocket for holding and retaining a bar or cake of soap, and the draw strings provide a pair of handles to be held by both hands of the user as the band containing the soap is manipulated over the user's body. Although such a device may be useful in reaching remote portions of the user's back, for example, the draw string handles are superfluous when it is desired to wash the front portion of the body as well as under the arms and leg regions.

Other attempts have been made to provide a satisfactory soap and washcloth assembly, such as those disclosed in U.S. Pat. Nos. 2,829,392 and 2,607,940. However, these assemblages and devices suffer from many of the problems and difficulties mentioned above.

SUMMARY

There are presently various types of bags or cases with locking type means or lids to secure a small article within. However, especially in use with soap or like articles, these cases do not give the utmost security, thus allowing the enclosed article to escape, particularly as the soap article gradually gets smaller and more elusive.

My novel Roll-in Case, made of soft, flexible material with a lateral opening in one portion thereof, with its ends closed, but with no mouth or opening leading directly to the very center of the case, is new to the art, inasmuch as the article to be enclosed in the case can only be placed inside the case by a novel rolling-in process. This is to say, instead of resorting to expensive and often unsatisfactory fastening means, the case in accordance with this invention teaches an arrangement in which the case is turned inside out for a number of times in a first direction, the item or items placed adjacent the lateral opening, and the case then turned inside out for the same number of times in the opposite direction, thus to cause the item or items to be deposited in the interiormost portion of the case, where they are surrounded by at least two layers of cloth or other material on all sides. By using a net material such as tulle, the case can possess a texture such that a desirable amount of gentle, skinstimulating scrubbing action can be achieved should the inserted item be soap.

This case also becomes a kind of puzzle to young children, giving them a feeling of accomplishment when they figure out how to remove the enclosed article while still keeping the case neat and intact.

This lock-tight case may be made of a single layer of material, or multiple layers of very thin or porous material, but in either instance, the style of double-(or triple)- wrap remains as the security feature. The advantages of multi-layers, then double-wrapping, become more evident when used with soap, as the recommended material in bath-soap use for the case is tulle. This is a very fine net material, which has slightly abrasive scrubbing quality, yet remains soft to the touch, and retains the feature of keeping the enclosed soap from slipping from the hand by having the case easier to grip than raw soap. The roll-in case can be used in conjunction with soap or with a sponge or pad, or with both together, depending on the desire of the user.

A coarse net such as nylon, especially in use over a large rectangular sponge, forms an excellent roll-in, lock-tight case for use as a floor-scrubber. A clip-on handle can be added. This multilayered, multiwalled case serves to protect the enclosed sponge and/or soap from excessive wear, and can be removed to be washed and quickly dried, or washed and dried on the sponge, while at the same time its tight conforming fit keeps the sponge in its original desired shape. This outer case can house a folded pad of material, all parts then becoming removable and replaceable, so that inner article can be replaced, or alternatively the outer case can be removed and replaced.

The finished cases can be made by pre-rolling tubular material until the desired double wrap or triple wrap is effected, and a lateral opening created, afer which the ends are secured to complete the case. Cases can be made in quantity by rolling a length of material, stitching the ends and double row stitching at spaced intervals between the ends. Then by cutting at locations between the double row of stitching, individual cases are formed. To make material tubular that is otherwise flat, a seam may be, of course, required. This seamed edge can be placed so as to be at edge of flap in finished case, by using it at the start or the finish of the rolling process.

The preferred material for the case is silk or nylon tulle, which does not mildew when used in the bath, and even suspends the enclosed article, especially soap, so that air can circulate around the enclosed article more freely, especially when numerous layers of material are used.

Long nylon net strap loop or loops can be used with, or added to the case to serve as a backscrubber, handle or a device to hang the article. This strap-loop or a handle is extra and can even clamp on and off, as optional.

My novel roll-in case is useful for enclosing items such as jewelry, coins, scented articles, sachet brick, etc., keeping them securely within and thus free from scratches from outside objects. The cases may be made in bright colors, or coded colors for storing items, with green for example being used to contain nickels, red for dimes, and blue for pennies. Small articles otherwise easily lost may be placed in my novel cases, which in turn are pinned to display racks for transport, with such cases taking less room than individual boxes in shipment. My cases can also be used as gift-wrap for special articles, with the cases later becoming available for use as soap or jewelry-containing devices, thus avoiding the disposal problem that would be present if superfluous boxes were used to package the articles. Colorful versions of my cases serve as a bonus or gift, as well as an advertising feature for a company.

As should now be apparent, my novel Roll-in Case enables an article to be securely placed within several surrounding walls, with no unrestricted opening easily visible to the innermost section, thus giving double escape-proof security to the enclosed article without involving the use of a fastener. Such a complete double-wrap security is novel, useful and unobvious, especially as regards the roll-in case for slippery articles such as wet soap, articles requiring security, or articles needing bulk.

It is therefore a primary object of my invention to provide a highly utilitarian locking case of inexpensive construction.

It is another object of my invention to provide an inexpensive yet highly effective locking case that requires no fastening devices of any type in order to securely contain any of a wide variety of items.

It is yet another object of my invention to provide a novel locking case of fabric, plastic or the like, having a number of folds or convolutions, with the arrangement being such that by following an easily-pursued installation procedure, an item to be contained or safeguarded can be placed in the most interior portion of the case.

It is still another object of my invention to provide a novel locking case of fabric or like material that can be manufactured by a straightforward procedure, and utilized by the average person for a variety of purposes.

Figures 2A, 2B, 2C, 2D, 2E, 2F:
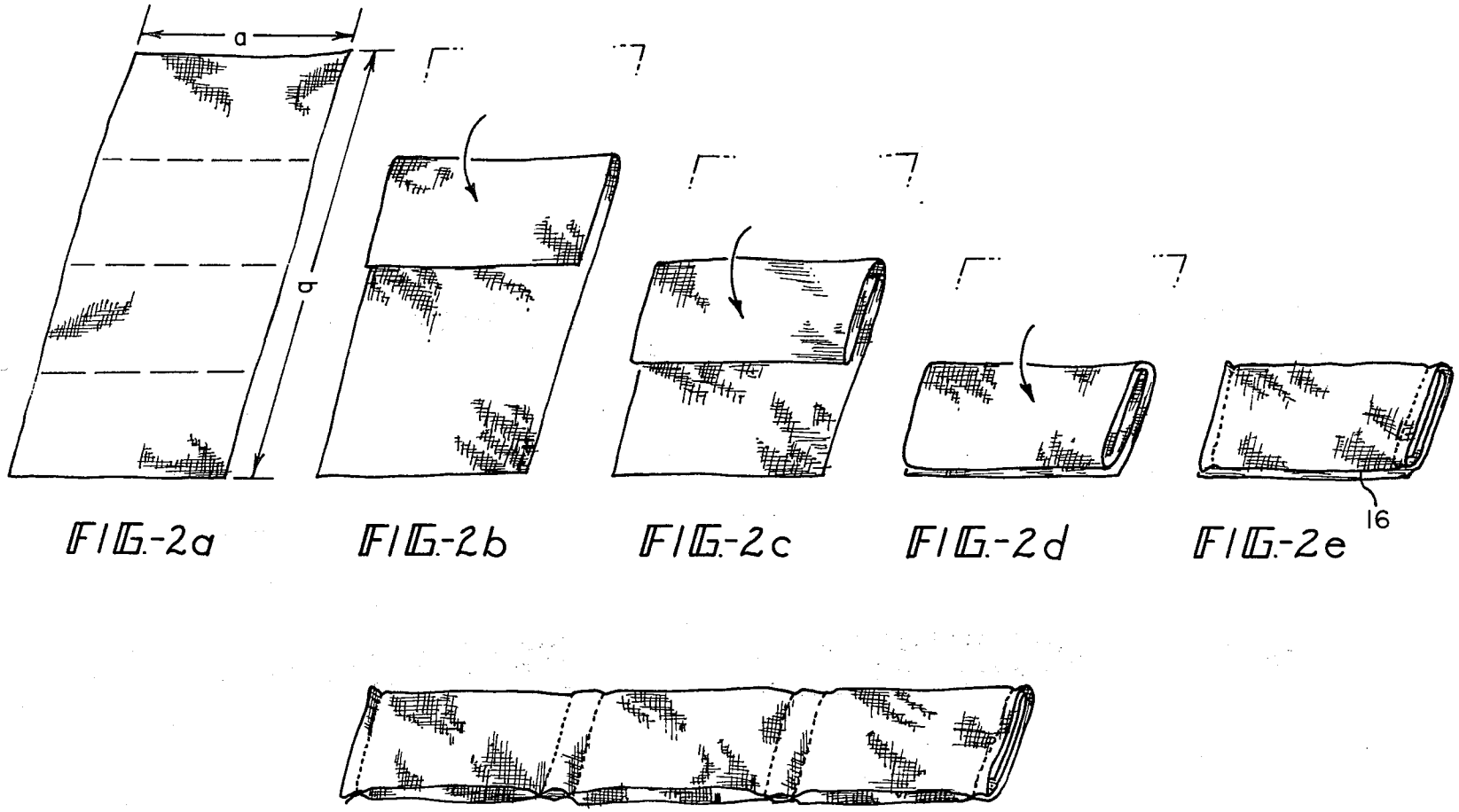
Figure 3E:
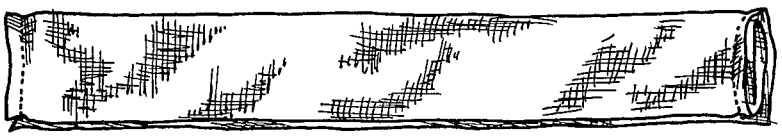
Figure 3F:
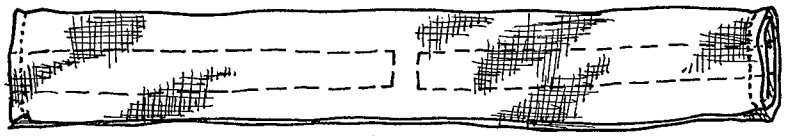

These and other objects, features, and advantages will be more apparent from a study of the enclosed drawings wherein FIG. 1 is an overall view of a novel locking case in accordance with a preferred embodiment of my invention;

FIGS. 2*a* through 2*e* are a series of related views, showing the folding of material so as to form a locking case of the general configuration shown in FIG. 1, with FIG. 2*f* showing how several cases can be formed at the same time;

FIGS. 3*a* through 3*d* are also a series of related views, but in this instance the locking case is constructed in such a manner as to provide an elongate case, as shown in FIGS. 3*e* and 3*f;*

FIGS. 4*a* through 4*d* are a series of related drawings revealing how the user manipulates the case in a certain manner in order to achieve an encapsulation of an article, such as a box or pad, but in this instance, a bar of soap; and FIGS. 5*a* through 5*f* are a series of related figures, with these revealing a somewhat different procedure undertaken by one desirous of encapsulating an item.

DETAILED PROCEDURE

Turning to FIG. 1, it will there be seen that I have shown an exemplary version of a locking case 10 in accordance with my invention. It is to be noted that this case may be made of a number of folds or layers of flexible material that are caused to be disposed in a desired relationship to each other by virtue of a rolling procedure described hereinafter, which layers are then held in the desired relation by the use of securing means at the ends 12 and 14. As will be discussed hereinafter, the folds or layers of material are caused to be disposed in the correct relation to each other by the use of a multistep procedure, after which all layers at each end are closed by sealing, stitching or the like. In one embodiment, the stitching involved the use of elastic thread. As a result, a locking case is created that can suitably contain items as commonplace as a bar of soap, scrubbing compound, a sponge or the like, or estoric items such as jewelry or other valuables. A mouth or aperture 16 is created during the construction of my novel case, and this aperture is used during the turning procedure described hereinafter. After one turn, a pocket is created into which the item is placed at such time as the encapsulation procedure is to commence. The aforementioned aperture preferably is disposed along the longest side of the finished case.

When the item or items have been properly encapsulated in my novel case in accordance with a procedure described hereinafter, they are not subject to dislocation, so it is highly unlikely that a bar of soap will work its way out of the case during even vigorous scrubbing action, nor will jewelry or other valuables be likely to be lost out of the case during storage, handling or transit.

Before discussing the procedure by which an item to be encapsulated is installed in my novel case, it is pertinent to describe the procedure by which my locking cases are made. As revealed in FIG. 2*a*, a generally rectangular sheet of material is first selected, whose dimension *a* is chosen with regard to the length or major dimension of the item to be encapsulated, and whose dimension *b* is chosen with regard to the number of times the material is to be folded, and with regard to the width as well as the thickness dimension of the item to be encapsulated. Obviously, the sizing of the material should be generous so as to take the thickness of the object to be encapsulated into consideration. The type of material used is chosen with regard to the type of usage the case is to receive, and, for example, in the event the case is to receive bath soap, I may utilize a very fine net material such as tulle, which has a desirable abrasive texture as to make effective scrubbing possible, yet it is soft to the touch. If more rigorous scrubbing is to be involved than would likely be desirable by a bather, the material may be of a coarser net. The material may be either a single thickness, or multiple thicknesses.

FIG. 2*b* reveals the material after a first fold has been made in the lengthwise direction, or, in other words, after a first turn has been made in a direction orthogonal to shorter side *a*. Quite obviously, the first fold as well as the successive folds are made involving only a portion of the total length dimension *b* of the material, which is to say, I do not fold the material in "halves" for a plurality of times, as one might fold a sheet or tablecloth for example. Rather, I create folds at three or so essentially equally spaced locations and then bring about what may be regarded as a type of rolling motion.

Figure 3A:
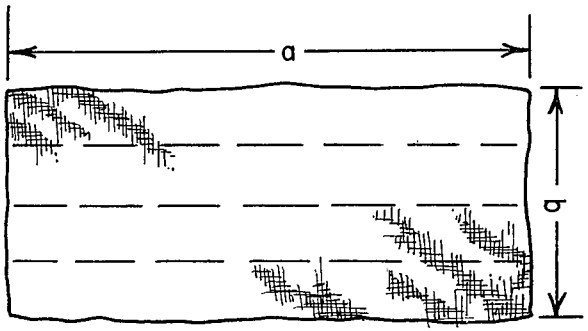
Figure 3B:
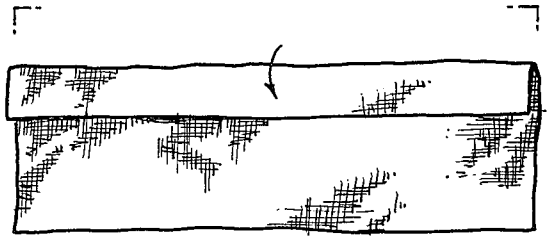
Figure 3C:
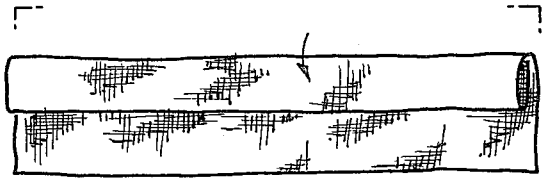

FIG. 3*c* reveals the appearance of the item after a second fold has been made, and FIG. 2*d* reveals the appearance of the item after the third fold has been made. Obviously either more folds or less folds than those shown in these related figures may be made, but the illustrated arrangement is typical and most effective in that it puts at least a double layer of material on each side of the object enclosed.

With reference to FIG. 2*d*, it is to be noted that the open edges or ends are now to be secured so as to form a proper case in accordance with this invention; note FIG. 2*e*. This securing of the ends can be accomplished by stitching, gluing, sealing by heat, or the like, and must include all layers.

As a result of the operations thus far described, I have formed a case having a mouth or aperture 16 that can be utilized in connection with the encapsulation of soap, jewelry or other items, but which aperture, significantly, does not directly lead into the center portion of the case. Rather, it is only by following the encapsulation procedure described hereinafter that an item can be caused to be disposed in the innermost portion of the case, where it is safe from dislodgment and loss.

With reference to FIG. 2*f*, it is to be noted that I am not to be limited to the manufacture of a single case as the rollup procedure outlined above is followed. Rather, it is to be observed that I may utilize material of a dimension two, three or more times that of dimension *a* shown in FIG. 2*a*. Then, after stitching or otherwise securing the material in a plurality of locations, the material can be cut so as to bring about the creation of a plurality of cases in accordance with this invention. Quite obviously, if adjacent straight stitches are accomplished in a plurality of locations as shown in FIG. 2*f*, by cutting between the pairs of closely adjacent stitches, I can bring about the severance of a plurality of cases in accordance with this invention.

Figure 3D:
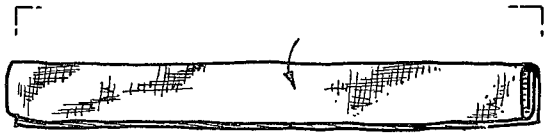

It is to be realized that I am not to be limited to a locking case wherein the shorter side measurement of the material used corresponds to the longest side of the article to be encased, and along whose long side, folding is to take place. Referring to FIG. 3*a*, it will be noted that this figure reveals the use of a rectangular piece of material wherein dimension *a* is several times that of dimension *b*, with folding to take place along lines parallel to the long edges of the material. As is obvious, the novel locking case created by the folding steps revealed in FIGS. 3*b* through 3*d* is ideal for an elongate item to be encapsulated, such as a folded fan. FIG. 3*e* reveals the securing together of all the layers at each end of the case, and FIG. 3*f* reveals the application of strap handles, which are optional. If used, they are typically secured in place at the time the ends are secured together.

The construction and use of my invention will be made more clear by reference to related FIGS. 4*a* through 4*d*. It is to be seen in FIG. 4*a* that the thumbs of the user can be inserted in the aperture or mouth created during the folding procedure just described. Turning the case one turn forms the pocket into which an item is to be inserted.

Figure 4B:
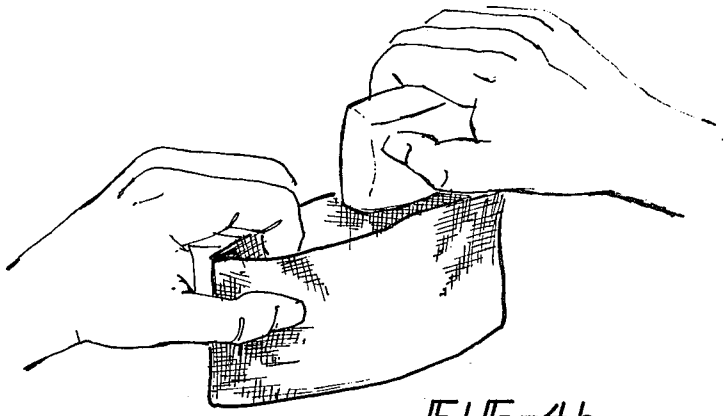
Figure 4D:
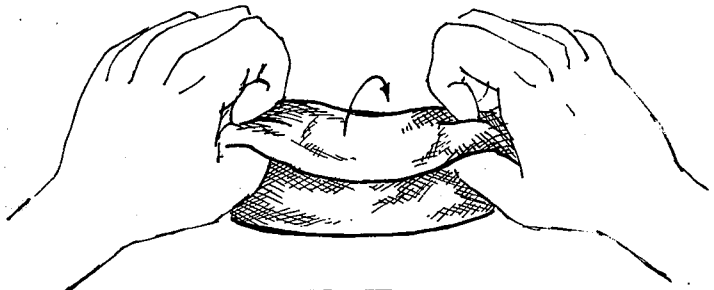
Figure 4A:
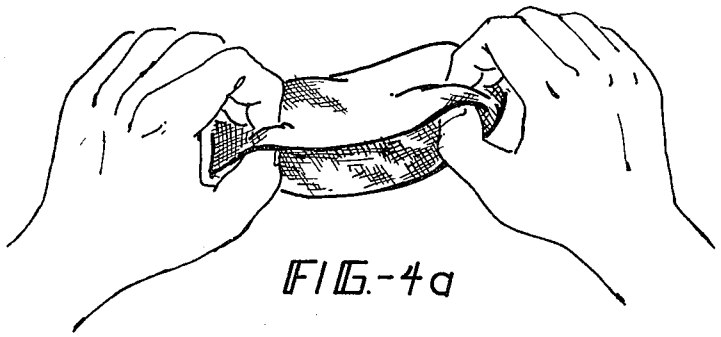

With the thumbs and the respective forefingers grasping the thinner portion adjacent the aperture in a form of pinching action, the forefinger-thumb combinations or "pinchers" can be turned toward each other in a substantially simultaneous motion that results in this portion of the case being turned inside-out. At this point the user can drop the item to be encapsulated into the pocket created, as shown in FIG. 4*b*. It may be noted a "new" pocket is formed on the opposite edge of the case from the first pocket edges.

Figure 4C:
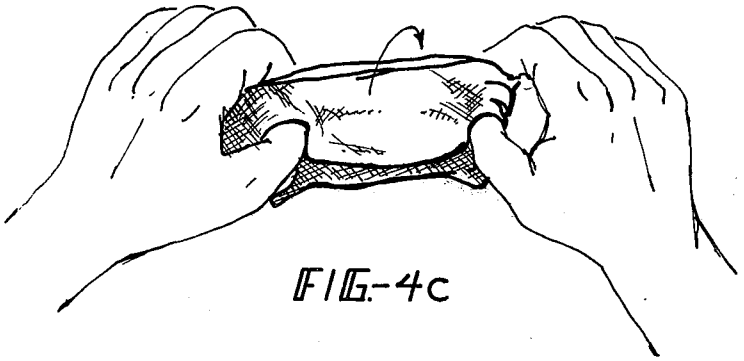

The user now inserts his or her thumbs into the new pocket just formed, as shown in FIG. 4*c*, and proceeds to "pinch" the case in the manner just described, and to then utilize a hand motion resulting in the case being turned inside-out in the direction tending to encase the item or object. It should be noticed at this time that another new pocket is created as a result of this action; see FIG. 4*d*.

The thumbs are now inserted into the newly formed pocket and an additional rolling motion utilized so as to further encase the item or object. The item is now encased. However, for triple wrap, I typically continue turning the case inside-out in the aforementioned manner until no so-called "new pocket" appears. At this point the object is completely encased, and safe from dislodgment.

The user of my novel case is not obligated to precisely follow the procedural steps just outlined. Turning to related FIGS. 5*a* through 5*f*, it may be seen that the encapsulating of a given item can be brought about by following somewhat different steps that lead, however, to the attainment of the same goal.

Figure 5C:
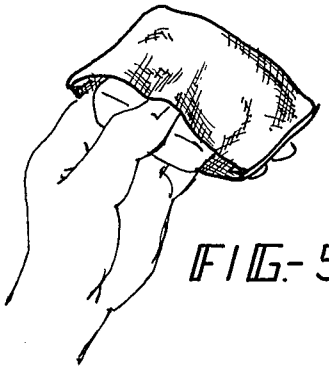
Figure 5F:
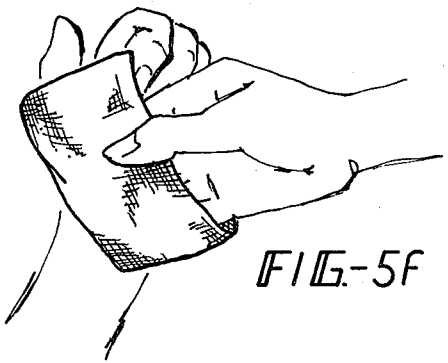
Figure 5B:
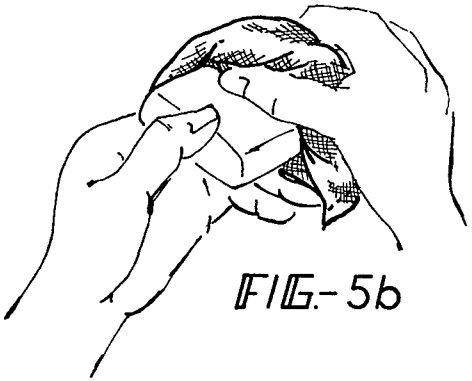
Figure 5E:
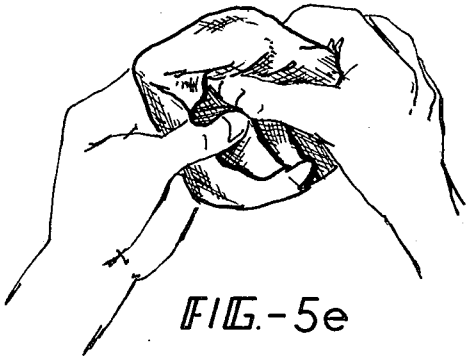
Figure 5A:
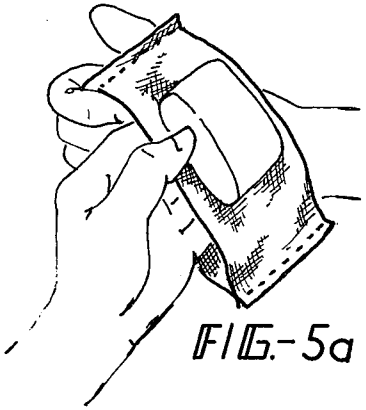

In FIG. 5*a*, with the exterior of my novel case having only a single pocket showing, the fingers of say the left hand are inserted into the pocket, and the thumb is used to hold an object, such as a bar of soap, against the flap side, or in other words, against the portion of the case that is of minimal thickness. As further shown in FIG. 5*a*, the fingers of the other hand engage and grasp the rear edge of this opening, which is of course a multi-thickness portion of my case. With appropriate relative motion of the two hands, the pocket is turned in the manner shown in FIG. 5*b* so as to cause the soap or other item to be partially encapsulated, as seen in FIG. 5*c*. This step causes a new pocket or opening to be formed along the edge remote from the hand shown in this latter figure.

Figure 5D:
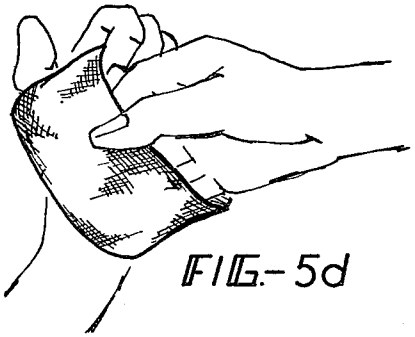

As shown in FIG. 5*d*, with one hand the case is again grasped at the location of the item to be encapsulated, and with the fingers of the other hand, the remaining portion of the case is pulled around, in the manner explained in connection with FIG. 5*c* so as to cause the item to be moved nearer to the interior of the case, and so as to cause an additional new pocket to be formed.

FIGS. 5*e* reveals the placement of the thumbs during the procedure of turning the case inside out, and FIG. 5*f* reveals the placement of hands as the folding proceeds. As before, this procedure of turning the case inside-out is continued until such time as the item is caused to be disposed in the innermost portion of the case, and no more new pockets have been formed.

Materials which are generally associated with definite uses are also consistent for use for making the roll-in lock-case. Satin material alone or in combination with nylon net becomes a soft pretty case and/or lining for delicate objects such as gems or jewelry. The color and texture effect enhances the case in that it is attractive to sight and touch. Flannel or terry cloth can be the flexible material used for a case for silverware, or jewelry. A crepe-paper lock-in case could even house, as a puzzle, a prize for children's party gifts or in snack boxes. A stronger lock-in material would make the puzzle aspect of the case, hiding an object, then recovering it, more lasting in use.

Relative to the lock-case appearance with the aperture along one edge, and having two case sides after sealing, I shall distinguish between the two case sides by calling the thinner layer side the flap side, and this is the single layer portion adjacent the aperture. The aperture leads to a pocket, for as the case is turned, the new apertures and pockets appear alternately at opposite ends of the lock-case as shown in FIGS. *4b–4d*.

The handles or long flat straps shown in FIG. *3f* are of folded material that can be fashioned inside the lock-case, in that the ends of the strap are simultaneously sealed as the lock-case is sealed or stitched. As the soap is rolled into the case, the handles are rolled out of the case in the same rolling process. In other words, the procedure of turning the case inside-out to encapsulate soap or other such item terminates with the liberation of the handles that were in the interior of the case at the time it was sold.

The handles, though optional, when folded into a small size also can serve as extra bulk or padding when a plumper lock-case is desirable.

The sealing or stitching 12 and 14 as shown in FIG. 1 may be done in close proximity to the case edge, or in locations more toward the case center with forethought as to the use of the case desired. Wide seam allowances can become short handles, or if the case is reversed the wider seams inside the case then give bulk. The stitching may be done at the case ends with elasticized thread. The gathering of material which results from the elastic thread feature tends to round off the case corners so that even round objects or round or oval soap is accommodated with a more contour shaped case. The article or object is rolled into the case by manipulating the fingers in the new pockets and turning the object and case as previously described, until the object is rolled up in the material forming the case. With a little practice, the roll-up process becomes a quick, easy almost automatic operation.

Slight variations or additions to the basic method are not intended to detract or change my roll-in case, but rather to enhance its possibilities for use.

Small contour cases can be equipped with the short handles which are easy to grasp.

These cases can contain cleaning compound and be used and discarded, or the cases can contain sachet and be called sachet kisses because of their like appearance to candy kisses in shape as a novel feature and use of an accepted vocabulary word.

The roll-in cases can be sold in their desired utilitarian form. In FIG. *5a* the case has been turned inside-out so that any seam raw edges may be visible. This state of the case may be marked by color if desired and is used at the start of the roll-up methods described in FIGS. *4a* and *5a*. There is often no need to differentiate which side of the case is the outside, except for esthetic reasons or the individual special uses of the roll-in case.

I claim:

1. A method for creating a locking case of flexible material for containing one or more articles such as soap, sponge, valuables or the like comprising the steps of:

a. Selecting a desired net material of generally rectangular configuration, whose one side measurement corresponds to the longest side of an article to be encased, and along whose other side, folding is to take place, b. Rolling the material over in a number of successive turns in a direction orthogonal to the one side, thus to cause a diminishment of the length of the other side, c. Continuing the procedure until at least three successive folds have been created, with each such successive fold being only slightly larger than the preceding folds, d. Securing the opposite ends of the folded material closed, with such securing being accomplished in the direction in which the folding took place, thus to create a multiple thickness case having a visible lateral opening formed at the terminating edge of the material, e. Placing the article to be encapsulated against the outer portion, adjacent the terminating edge of the case thus formed, f. With the article contiguous to the case, and making use of the opening, proceeding to turn the case to the inside for several successive turns until such time as the article has been caused to be disposed in the innermost part of the case.

2. The method as defined in claim 1 in which such securing is accomplished by stitching.

3. The method as defined in claim 1 in which such securing is accomplished by a sealing operation.

4. The method as defined in claim 1 in which a multiple thickness is created in the net material before the material is rolled in the direction to create the successive folds.

5. The method as defined in claim 1 in which subsequent removal of the article is accomplished by turning the case inside out in the opposite direction for the same number of times as involved the encapsulation of the article.

6. The method as defined in claim 1 in which said one side is of a lesser dimension than said other side.

7. The method as defined in claim 1 in which said one side is of a greater dimension than said other side.

8. The method as defined in claim 1 in which a strap is affixed at each end of said case, at the time said ends are secured.

9. A method for creating a locking case of net material for containing one or more articles, such as soap, valuables, or the like comprising the steps of:

selecting a length of net material of generally rectangular configuration;

selecting a dimension that corresponds to a principal dimension of an article to be encased;

rolling over the net material in the direction orthogonal to such selected direction, thus to create a number of successive folds, with each such successive fold being of approximately the same dimension as the first fold, until at least three folds have been completed;

securing together the layers of net material at each end of the folded material, with such securing being accomplished in the direction in which the folding took place, thus to create a case having a lateral opening formed at the terminating edge of the material;

placing the article to be encapsulated against the outer side of the case, adjacent the terminal edge thus formed; and utilizing the lateral opening, then proceeding to turn the case inside out for a number of times so as to cause the article to be disposed in the innermost part of the case.

10. The method as defined in claim 9 in which such securing is accomplished by stitching.

11. The method as defined in claim 9 in which such securing is accomplished by a sealing operation.

12. The method as defined in claim 9 in which a double thickness is created in the net material before the material is rolled in the direction to create the successive folds.

13. The method as defined in claim 9 in which subsequent removal of the article is accomplished by turning the case inside out in the opposite direction for the same number of times as involved the encapsulation of the article.

14. A method for creating a locking case of net material for containing one or more articles, such as soap, valuables, or the like comprising the steps of:

selecting a length of net material of generally rectangular configuration;

selecting a dimension that corresponds to a principal dimension of an article to be encased;

rolling over the net material in the direction orthogonal to such selected direction, thus to create a number of successive folds, with each such successive fold being of approximately the same dimension as the first fold, until at least three folds have been completed;

securing together the layers of net material at each end of the folded material, with such securing being accomplished in the direction in which the folding took place, thus to create a case having a lateral opening therein;

thereafter proceeding to turn the case inside out until such time as an interior portion has been reached;

placing the article to be encapsulated against the thinner side of the lateral opening of the case thus formed; and then proceeding to turn the case inside out for a number of times in the direction opposite the previous direction, so as to cause the article to be disposed in the innermost part of the case.

15. A reversible roll-in locking case of flexible material, such material being generally rectangular and of considerable length, and folded a plurality of times to form at least four approximately equal-sized layers; means securing together, at opposite ends of the folded material, the several oppositely-disposed edges so as to create an essentially flat case in which is defined a continuous, circuitous passageway having a single external opening extending virtually the entire distance between said secured edges, said opening serving to form a pocket, said case being amenable to a number of insideout movements, in which the bulk of said case is pushed inside-out through the opening, thus to cause the creation of an opening at a different part of said case, and to form a second pocket; manipulation of said successive pockets by inside-out turns making it possible for an item to be encapsulated by disposing it at a location adjacent the first external opening and thereafter moving it to an interior portion of said case by successive inside-out turns until such time as said case again has a single external opening.

16. The locking case as defined in claim 15 in which such securing is accomplished by stitching.

17. The locking case as defined in claim 15 in which such securing is accomplished by sealing.

18. The locking case as defined in claim 15 in which such securing is accomplished by the use of elastic thread.

19. The locking case as defined in claim 15 in which said material is tulle flexible.

20. The locking case as defined in claim 15 in which a flexible handle is secured at each end of said case.

21. The roll-in locking case defined in claim 15 in which a multiple thickness is created in the flexible material before the material is folded in the direction to create the successive folds.

* * * * *